US006151947A

United States Patent [19]

Arduino et al.

[11] Patent Number: 6,151,947

[45] Date of Patent: Nov. 28, 2000

[54] METHOD AND APPARATUS FOR THE PRODUCTION OF BENT SHEET METAL PIECES

[75] Inventors: Alberto Arduino; Gianpaolo Prunotto, both of Turin, Italy

[73] Assignees: Amada Company, Limited, Kanagawa, Japan; CREA s.r.l., Turin, Italy

[21] Appl. No.: 09/497,488

[22] Filed: Feb. 4, 2000

Related U.S. Application Data

[62] Division of application No. 09/084,016, May 26, 1998, Pat. No. 6,065,323.

[30] Foreign Application Priority Data

May 27, 1997 [IT] Italy ..... TO97A0447

[51] Int. Cl.[7] ..... B21D 5/01

[52] U.S. Cl. ..... 72/335

[58] Field of Search ..... 72/379.2, 388, 72/335

[56] References Cited

U.S. PATENT DOCUMENTS

| | | | |
|---|---|---|---|
| 411,117 | 9/1889 | Aiken | 72/383 |
| 5,375,630 | 12/1994 | Kim | 140/105 |

FOREIGN PATENT DOCUMENTS

| | | |
|---|---|---|
| 0 725 692 | 8/1996 | European Pat. Off. . |
| TO 93A0818 | 5/1996 | Italy . |
| 1-087018 | 3/1989 | Japan . |
| WO 95/11767 | 5/1995 | WIPO . |
| WO 96 24447 | 8/1996 | WIPO . |

OTHER PUBLICATIONS

French Search Report dated Dec. 4, 1998.

*Primary Examiner*—Lowell A. Larson
*Attorney, Agent, or Firm*—Blank Rome Comisky & McCauley LLP

[57] ABSTRACT

A method and apparatus for the production of bent sheet metal pieces (12) is disclosed. In the method or apparatus, a cut (14) is made in a sheet of sheet metal (10) that defines the perimeter of piece (12) to be obtained. The cut (14) is interrupted at preselected points to form a series of micro-joints (16) that keep the plan development of the piece (12) united with the stiffening frame (18) constituted by the remaining part of the metal sheet (10). At least one window (36, 38) is formed in the stiffening frame (18) in order to allow a pair of bending tools having a length greater than the length of the bend to form a bend (20, 22) on the piece (12) without interfering the stiffening frame (18) while the bend is being formed.

20 Claims, 7 Drawing Sheets

METHOD AND APPARATUS FOR THE PRODUCTION OF BENT SHEET METAL PIECES

This application is a Division of application Ser. No. 09/084,016 filed on May 26, 1998, now U.S. Pat. No. 6,065,323.

TECHNICAL FIELD

The present invention generally relates to the processing of pieces of sheet metal (hereinafter sheet metal pieces) by bending operations. The present invention is more particularly related to a bending operation of the type in which the developments in a plan (hereinafter plan developments) of the pieces to be bent are defined in the plane of a sheet metal by cutting the sheet along a cutting run interrupted at preselected points to form a series of microjoints that will keep the plan development of the piece united with the remainder of the sheet. The bending of the pieces is carried out while the plan development of each piece remains joined to the remaining part of the metal sheet by means of the microjoints.

BACKGROUND ART

Methods of the type just described are advantageous, above all, when the pieces to be bent are of relatively small size. In that case, in fact, the plan developments of several such pieces can be defined on a single metal sheet. The part of the sheet that surrounds the plan developments of the various pieces normally constitutes a waste but, before this material is thrown away, it is used as a kind of stiffener or stiffening frame that sustains the individual pieces during the bending operation. On completion of the bending operations, the bent pieces are separated from the stiffening frame by either cutting or breaking the microjoints.

A method for cutting and bending pieces of sheet metal in accordance with the steps just described in broad outline can be realized, for example, in an integrated cutting and bending system of the type described in Italian patent application No. TO95A00059 filed by the present applicant. In a system of this type the bending can be carried out in automatic fashion by means of the particular type of press described in EP-A-0725692. For the bending operations to be correctly performed in a system of this type, it is essential to employ bending tools (i.e. punch and die) of a length substantially the same as the length of the bend to be made. This implies the need not only of keeping a considerable stock of tools with a large number of spares, but also of frequently changing the tools used with the bending press whenever the bends to be made are of different lengths.

DISCLOSURE OF INVENTION

The present invention provides method and apparatus of the type described hereinabove that would make it possible to overcome these drawbacks.

According to the present invention, this scope can be attained by means of a procedure having the characteristics that form the subject of the principal claims hereunder.

The innovative concept underlying the present invention includes the fact that in the cutting phase at least one window is cut in the stiffener material adjacent to a bend to be formed in the piece. The dimensions of the window, or windows, are selected in such a way as to make it possible for the bend to be made with two tools (i.e. punch and die), each having a length greater than the length of the bend to be made; i.e. the tools interferes with the stiffener frame without the window, or windows.

This makes it possible to keep a smaller stock of press tools and to cut down the frequency of the tool-changing operations, with obvious advantages as far as idling times during the processing operations are concerned.

Further characteristics and advantages of the present invention will become clear in the course of the detailed description which follows, given solely by way of non limiting example, with reference to the attached drawings.

BEST MODE FOR CARRYING OUT THE INVENTION

Figure 1:
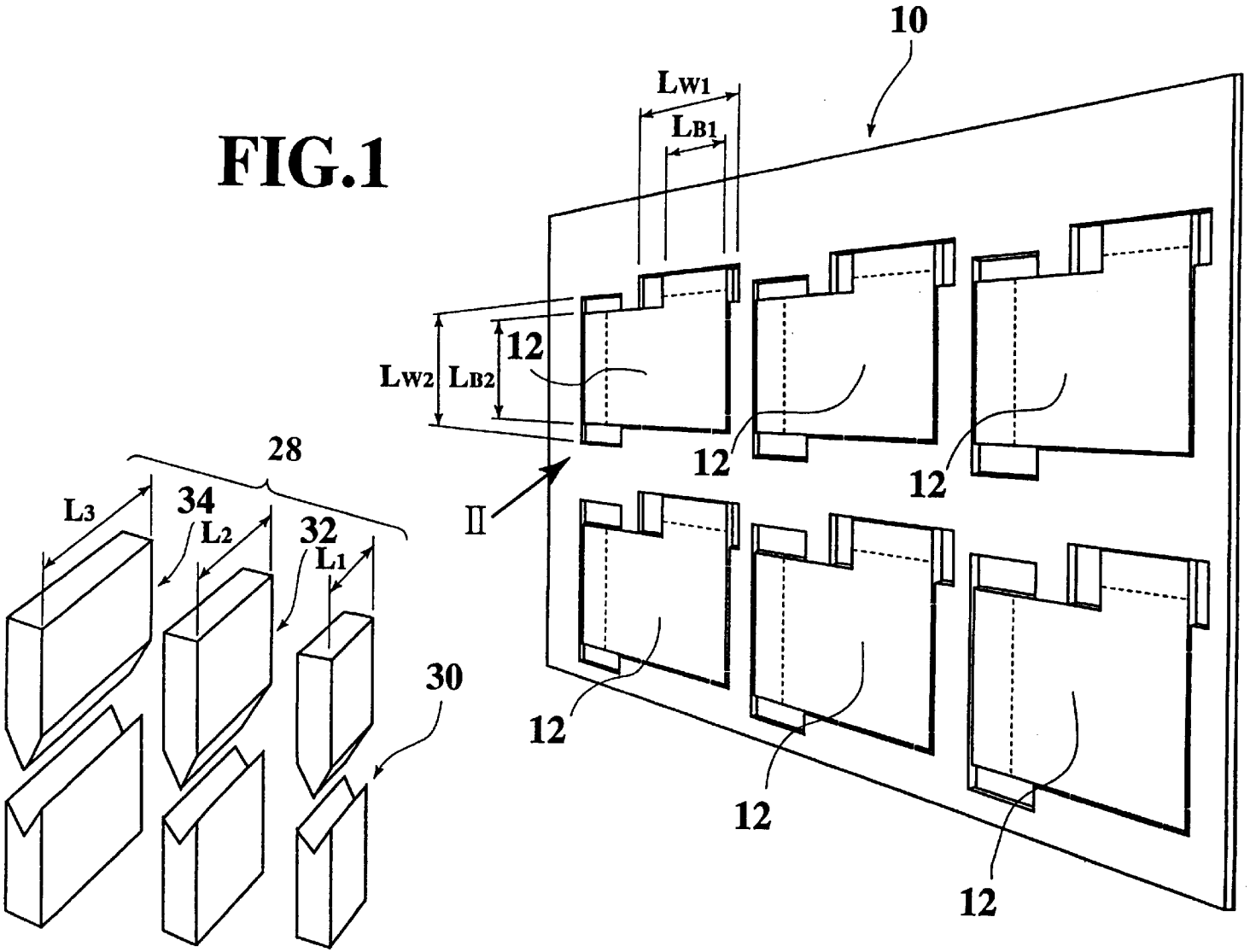
FIG. 1 shows a sheet metal prepared for carrying out the bending operations in the bending press and the selection of bending tools to be used with this machine.

The drawings attached hereto provide schematic illustrations of some phases of a method for the production of bent sheet metal pieces. During the course of the method the metal sheet 10 is first subjected to a preliminary cutting operation. The cutting operation is for defining on the sheet 10 the plan development of one or more pieces 12 to be obtained. The cutting operation may be carried out, for example, with a laser machine. FIG. 1 shows, for example, a case in which the plan developments of six identical pieces 12 have been obtained on the metal sheet 10. However, the method according to the invention can be employed no matter what the number or the shape of the pieces is obtained.

Figure 2:
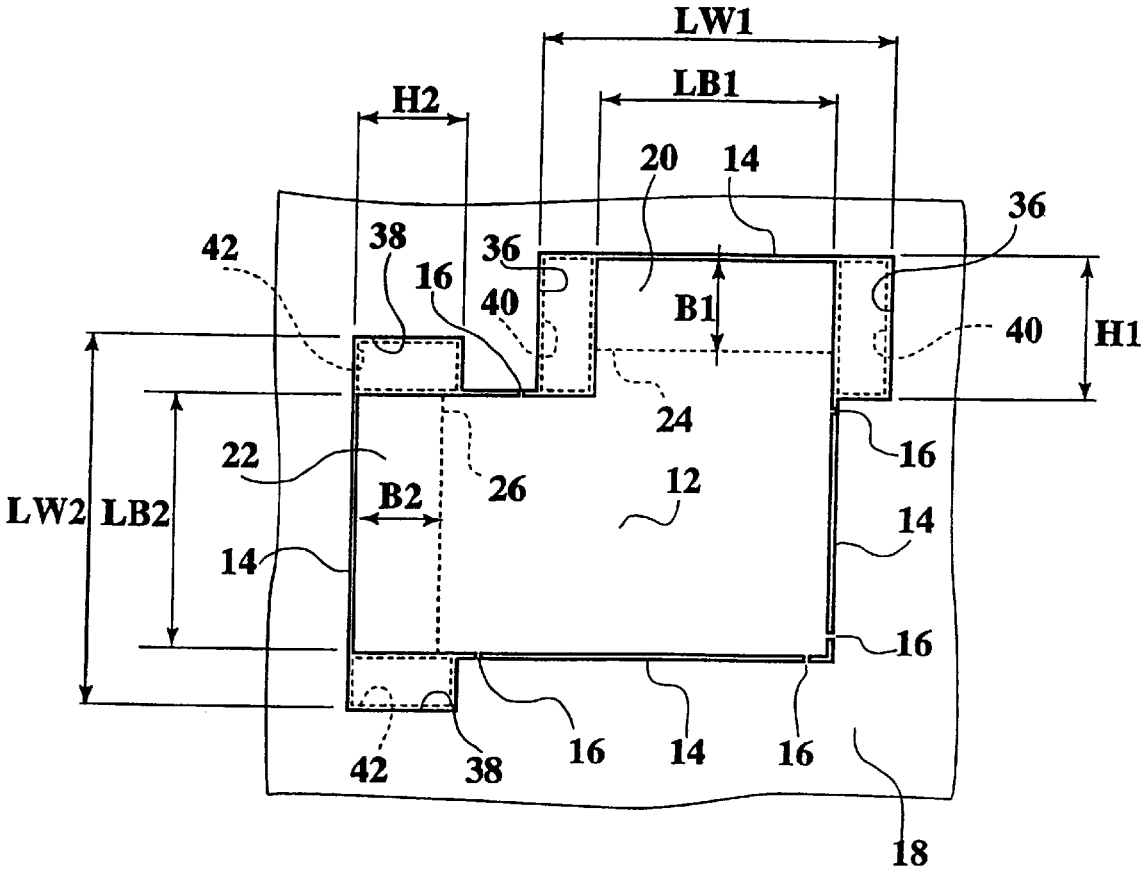
FIG. 2 is a schematic view at a larger scale of the part indicated by the arrow II in FIG. 1.

Turning now to FIG. 2, the reference number 14 indicates the cutting run or line along the outer perimeter of the plan development of one such piece 12. The cutting run 14 is interrupted at preselected points 16 in such a way as to form a series of microjoints that connect the plan development of the piece 12 to the remaining part 18 of the metal sheet 10. The remaining part 18 constitutes a stiffening frame used to support the pieces during the bending operation. As will be explained in greater detail below, the bending operations are carried out while the plan developments of the pieces 12 are still connected to the stiffening frame 18 by means of the microjoints. On completion of the bending operations, the finished pieces are separated from the stiffening frame by breaking or removing the microjoints 16. The breaking or removing the microjoints 16 may be performed by means of any known system and, preferably, the device and procedure described in Italian patent application No. TO94A000505 in the name of the present applicant.

In the example illustrated by FIG. 2, we shall suppose that two flaps or flanges 20, 22 have to be obtained by means of bending operation along the lines 24 and 26. The lengths of the two bends are shown in the figure as respectively $L_{B1}$ and $L_{B2}$.

The remainder of FIG. 1, schematically indicated by the number 28, shows the set of tools of a bending press to be used for bending the pieces. Purely by way of example, the stock of tools of the bending press not shown in the figure has been schematically represented by three punch-and-die pairs 30, 32, 34 of different lengths, these lengths being indicated by, respectively, $L_1$, $L_2$ and $L_3$. The bending press to be used for carrying out the bending operations can be, for example, of the type described and illustrated in Italian patent application No. TO93A000818.

In the case in which the available tool stock of the bending press includes a tool pair of the same length as the bend to be made, the bend may be made in the manner described in detail in Italian patent applications Nos. TO93A000818 and TO95A0005669. The present invention, on the other hand, is applied whenever the length of the bend to be made differs from the length of any available tool pair. In that case the procedure is as follows. As a preliminary, however, it should here be specified that both the cutting and the bending are carried out under the control of a programmable electronic unit, which makes it possible to transfer information from the cutting machine to the bending machine and vice versa. Appropriate information regarding the shape and size of the pieces to be obtained is stored in the electronic control unit, so that the control unit can readily obtain the necessary information about the length of the bend that is to be made. If none of the available tool pairs is of the same length as the bend to be made, the control unit selects a tool pair having a length L greater than the length of the bend to be made. By way of example, let us suppose that the bend $L_{B1}$ is of a length intermediate between the lengths of the tool pairs $L_1$ and $L_2$ and that the length of the bend $L_{B2}$ is of a length intermediate between the lengths of the tool pairs $L_2$ and $L_3$. In this situation the machine could select the tool pair 32 far making the bend 24 and the tool pair 34 for making the bend 26; alternatively, however, it could select the tool pair 34 of the length $L_3$ for making both the bend 24 and the bend 26. The selected tools can be fitted to the bending press by means of, for example, an automatic tool-changing system of the type described in detail in Italian patent application No. TO93A000818.

The information regarding the length of the tool pair selected for carrying out the bending operation is transferred to the cutting machine, which may be programmed in such a manner as to enable it to autonomously modify the cutting program formulated in the manner subsequently to be described. Alternatively, the choice of tools and the consequent modification of the cutting run can be carried out manually and then set in the control unit of the system that supervises the cutting and bending operations.

In any case, the cutting run 14 is modified with respect to the theoretical trace that coincides with the perimeter of the plan development of the piece 12. These modifications consist of cutting one or more windows on the bending lines 24, 26. In the example shown in FIG. 2, a window pair 36, 38 has been obtained on each of the bending lines 24, 26, the windows in each case being arranged at the opposite ends of the bend (i.e. flap or flange) 20, 22 to be obtained. The shapes and the sizes of these windows are determined in such a manner that there will be no interference between the tools and the stiffening frame 18 surrounding the plan development of the pieces 12 when the bends 24, 26 are made with the selected tool pairs. Firstly, the dimension of the windows 36, 38 in the direction of their respective bending lines 24, 26 must be such that the sum $L_{w1}$, $L_{w2}$ of the length $L_{B1}$, $L_{B2}$ of the bending line 24, 26 and the lengths of the windows 36, 38 along the bending lines 24, 26 is always equal to or greater than the length of the selected tool pair. When the tool pair 34 has been selected for making both the bends 24, 26 for example, the distances $L_{W1}$ and $L_{W2}$ may be substantially equal to each other and will be slightly longer than the length $L_3$ of the selected tool pair 34. In the direction at right angles to their respective bending lines 24, 26, moreover, the windows 36, 38 must have dimensions $H_1$ and $H_2$ equal to or greater than the widths $B_1$ and $B_2$ of the respective flaps 20, 22. The pieces of waste material that have to be removed by cutting in order to obtain the windows 36, 38 are shown by means of broken lines in FIG. 2, where they have been attributed the reference number 40 in the first case and 42 in the second case.

Figure 3:
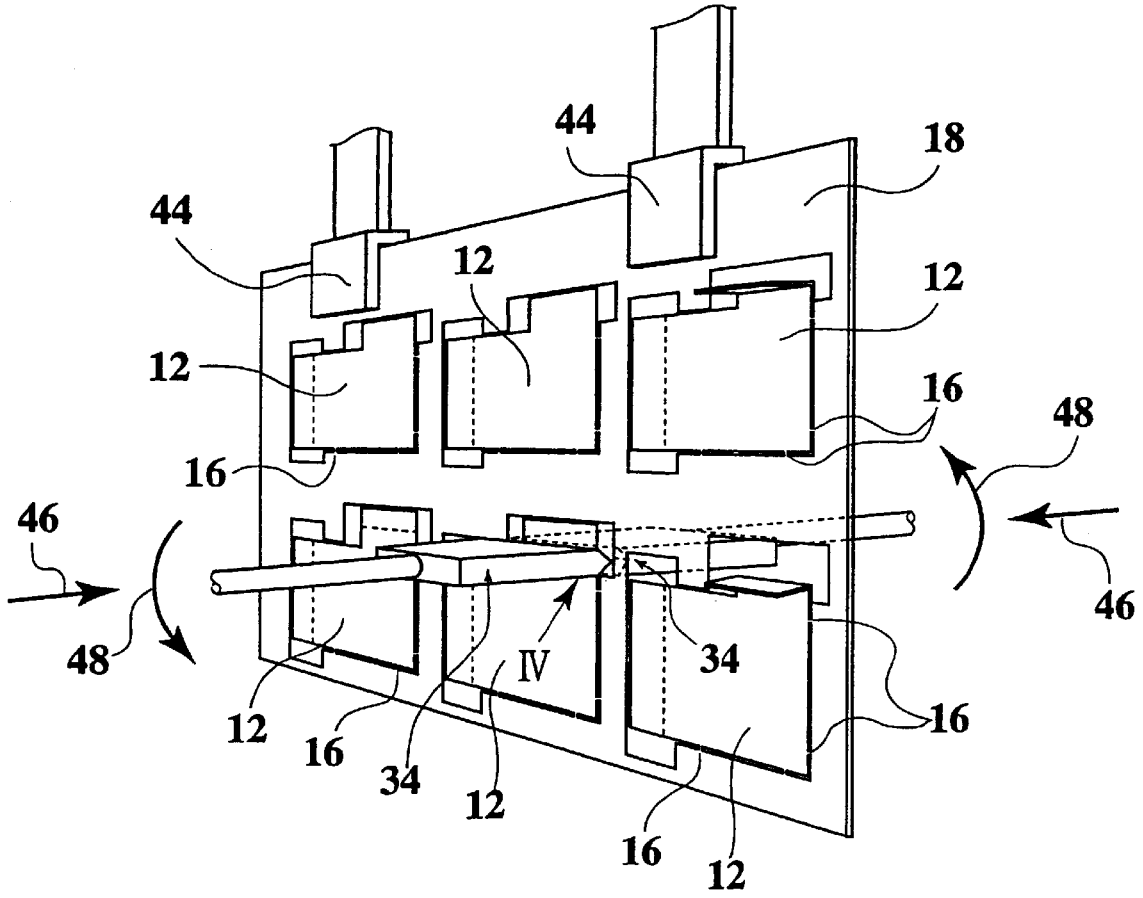
FIG. 3 is a schematic view of the metal sheet of FIG. 1 during the bending operation.
Figure 7:
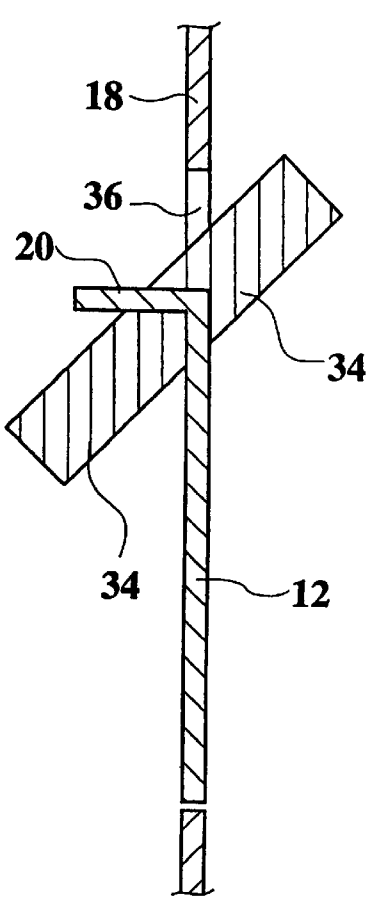
FIGS. 5, 6, and 7 show a section along the line V of FIG. 4 during the various phases of the bending operation.
Figure 6:
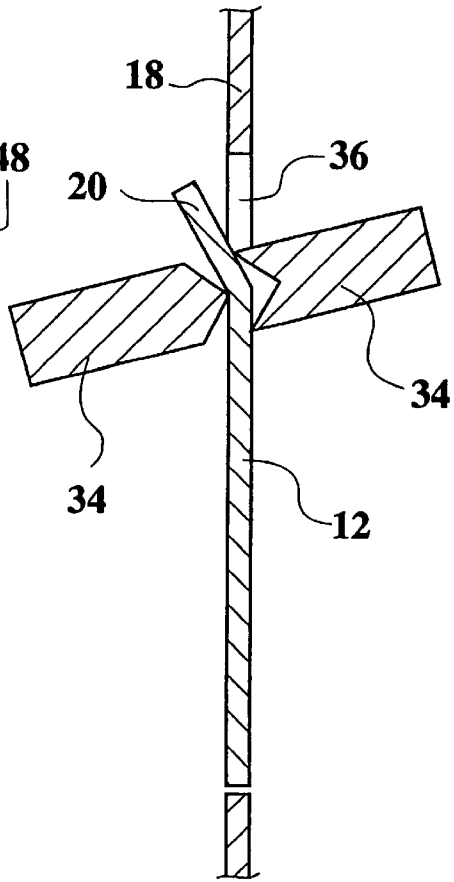

The bending phase is schematically illustrated in FIGS. 3 and 7. As can be seen from FIG. 3, the stiffening frame 18 is held in a vertical position by means of a pair of clamping elements 44. The selected tool pair, which may be the pair 34 for example, successively creates the bends of the various pieces while these are still connected to the stiffening frame 18 by means of the microjoints 16. Whenever it performs an individual bending operation, the punch-and-die pair 34 carries out an approach movement in the direction indicated by the arrows 46 in FIGS. 3 and 4. At the same time, the tool pair 34 performs a rotation in the direction indicated by the arrow 48 so as to rotate through an angle equal to half the bending angle to be made upon the flap 20 and so as to accompany the movement of the said flap see FIGS. 5, 6 and 7 in particular.

Figure 4:
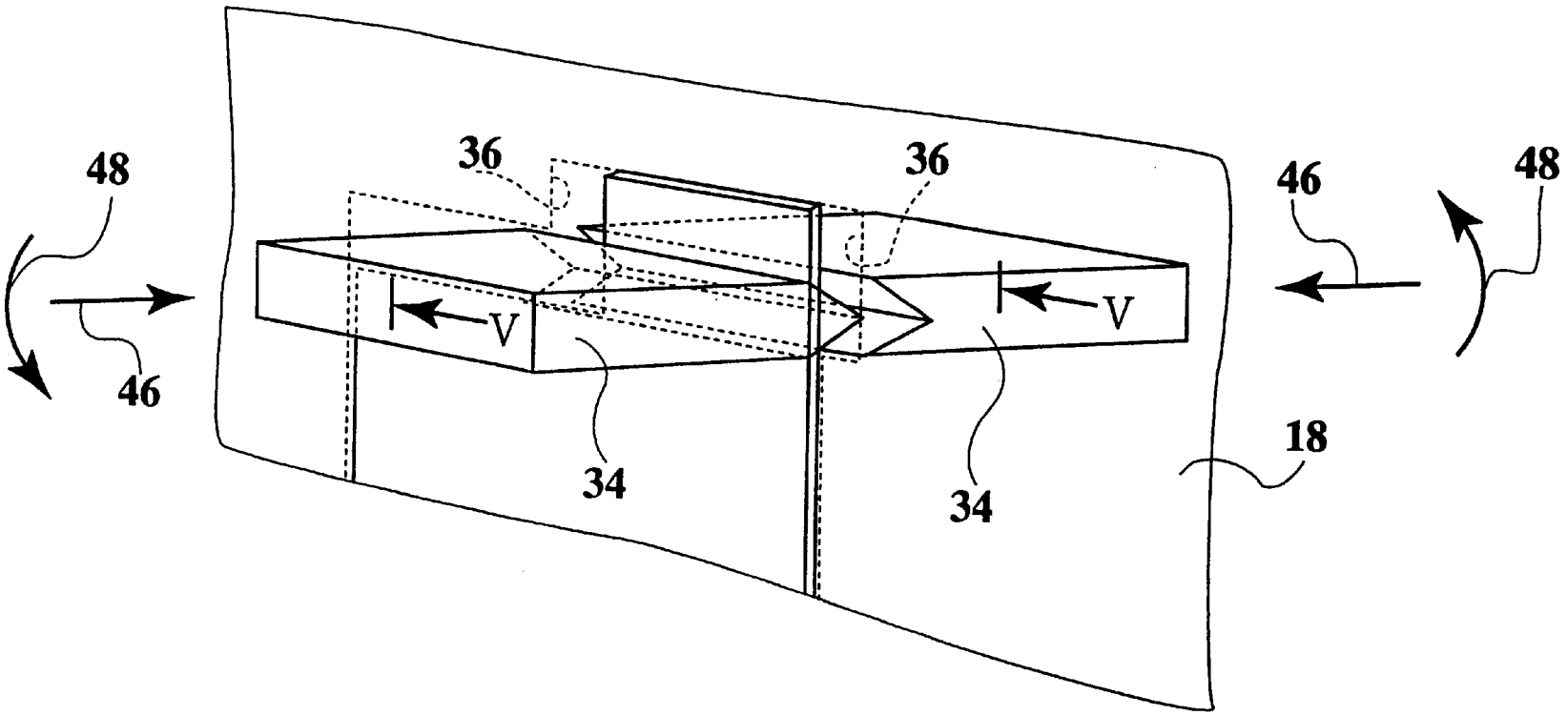
FIG. 4 is a schematic perspective view at a larger scale of the part indicated by the arrow IV in FIG. 3.
Figure 5:
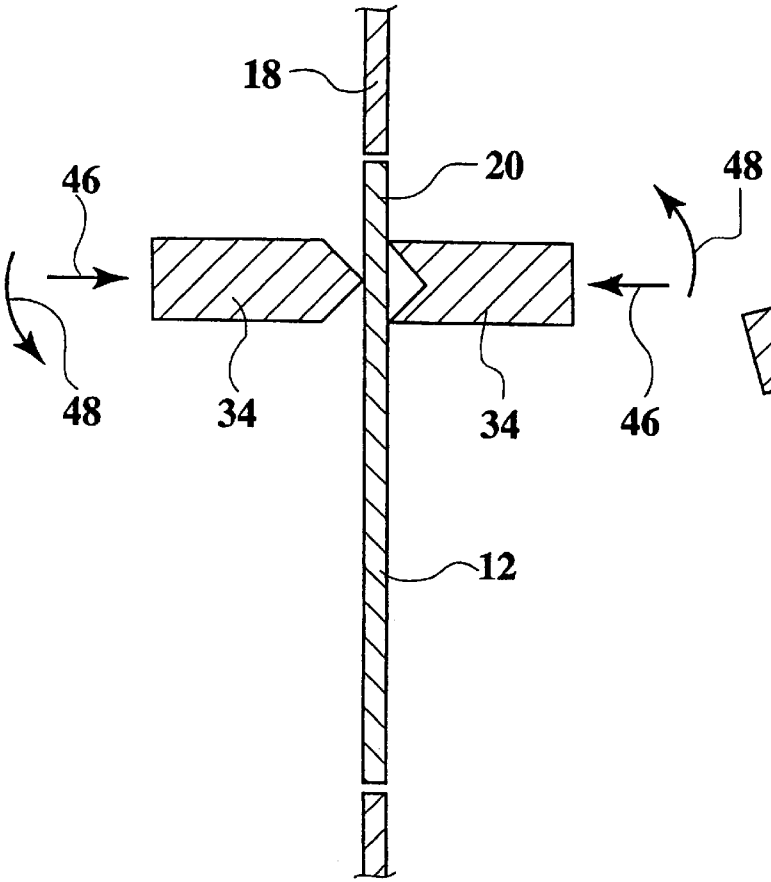

As can be seen in FIGS. 4 and 7, the windows 36, arranged and dimensioned as described above, make it possible for the bend to be obtained with a tool pair having a length greater than the length of the bend while avoiding any interference between the tools 34 and the stiffening frame 18.

After having performed all the required bending operations, while possibly replacing the tool pair 34 with another when ends of a different length have to be made, the entire metal sheet is transferred to another workstation, where the bent pieces 12 are separated from the stiffening frame 18 by means of cutting or breakage of the microjoints.

Figure 8:
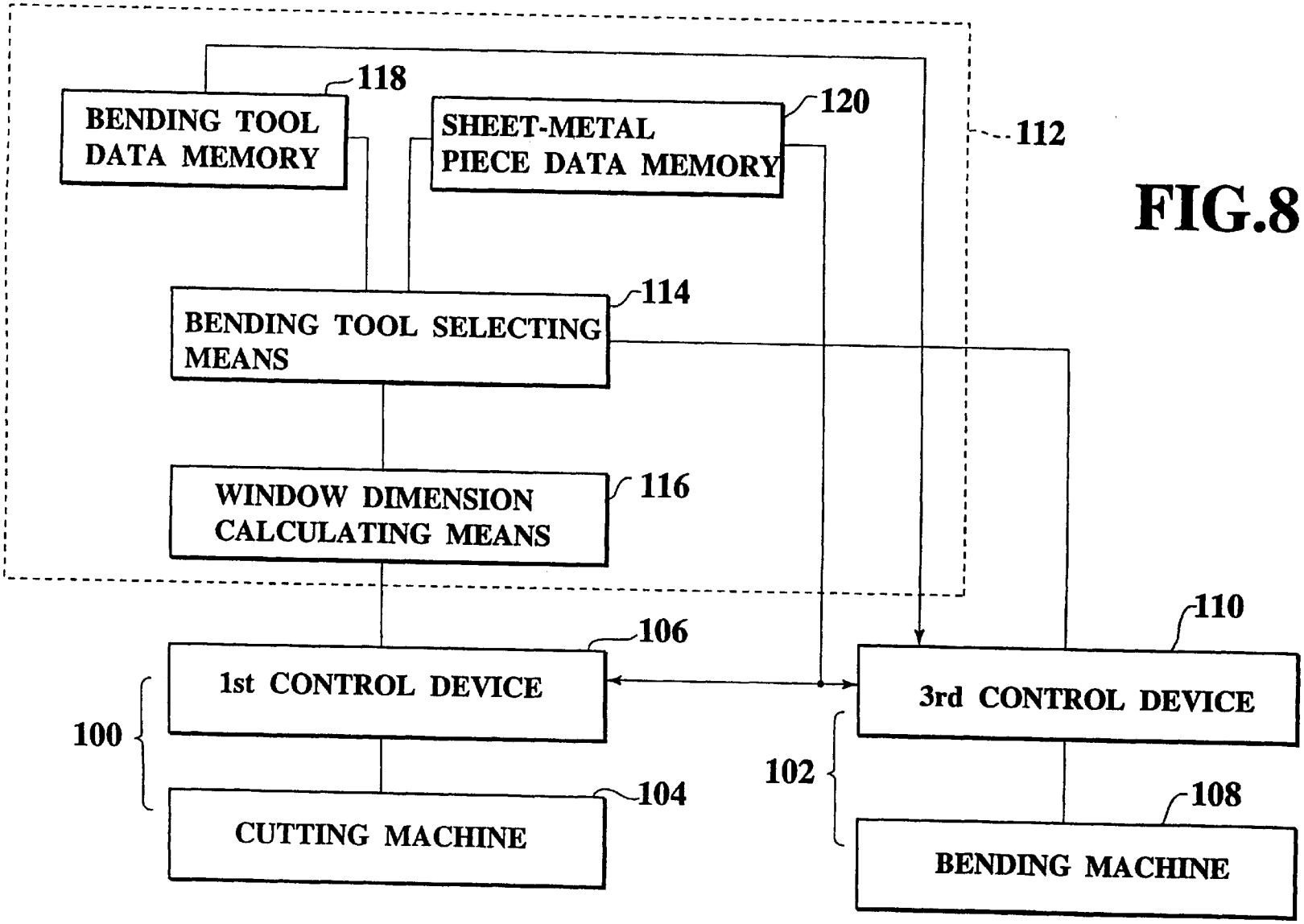
FIG. 8 is a block diagram of an apparatus in accordance with the present invention.

FIG. 8 is a block diagram of an apparatus for manufacturing sheet metal pieces having bent flanges in accordance with the method described above. This apparatus includes a cutting apparatus 100 for cutting a sheet metal 10 along a suitable line 14 to form sheet metal pieces 12 in the sheet metal 10, and a bending apparatus 102 for performing a bending operation on each of the sheet metal pieces 12 along suitable bending lines 24, 26. The cutting apparatus 100 includes a cutting machine 104, such as a laser cutting machine, for performing the cutting operation on the sheet metal 12 and a first control device 106 for controlling the operation of the cutting machine 104. Under the control of the first control device 106, the cutting machine 104 cuts the sheet metal 12 along the cutting line 14 to form the sheet metal pieces 12 in the sheet metal 10 and forms the windows 36, 38 in the stiffening frame 18. The bending apparatus 102 includes a bending machine 108, such as a press brake, and a third control device 110 for controlling the operation of the bending machine 108.

The apparatus of FIG. 8 further includes a second control device 112 for providing various date to the first and third control devices 106 and 110. The second control device 112 includes a bending tool selecting means 114 for selecting a bending tool to be used in the bending machine 108 and a window dimension calculation means 116 for calculating the dimensions of the window 36, 38 on the basis of the dimension of the bending tool selected by the bending tool selecting means 114. The second control device 112 further includes a bending tool data memory 118 for storing the dimensions (such as the lengths) of the available bending tools 34, and a sheet metal piece data memory 120 for storing data, such as shapes and dimensions, of the sheet metal pieces 12.

Figure 9:
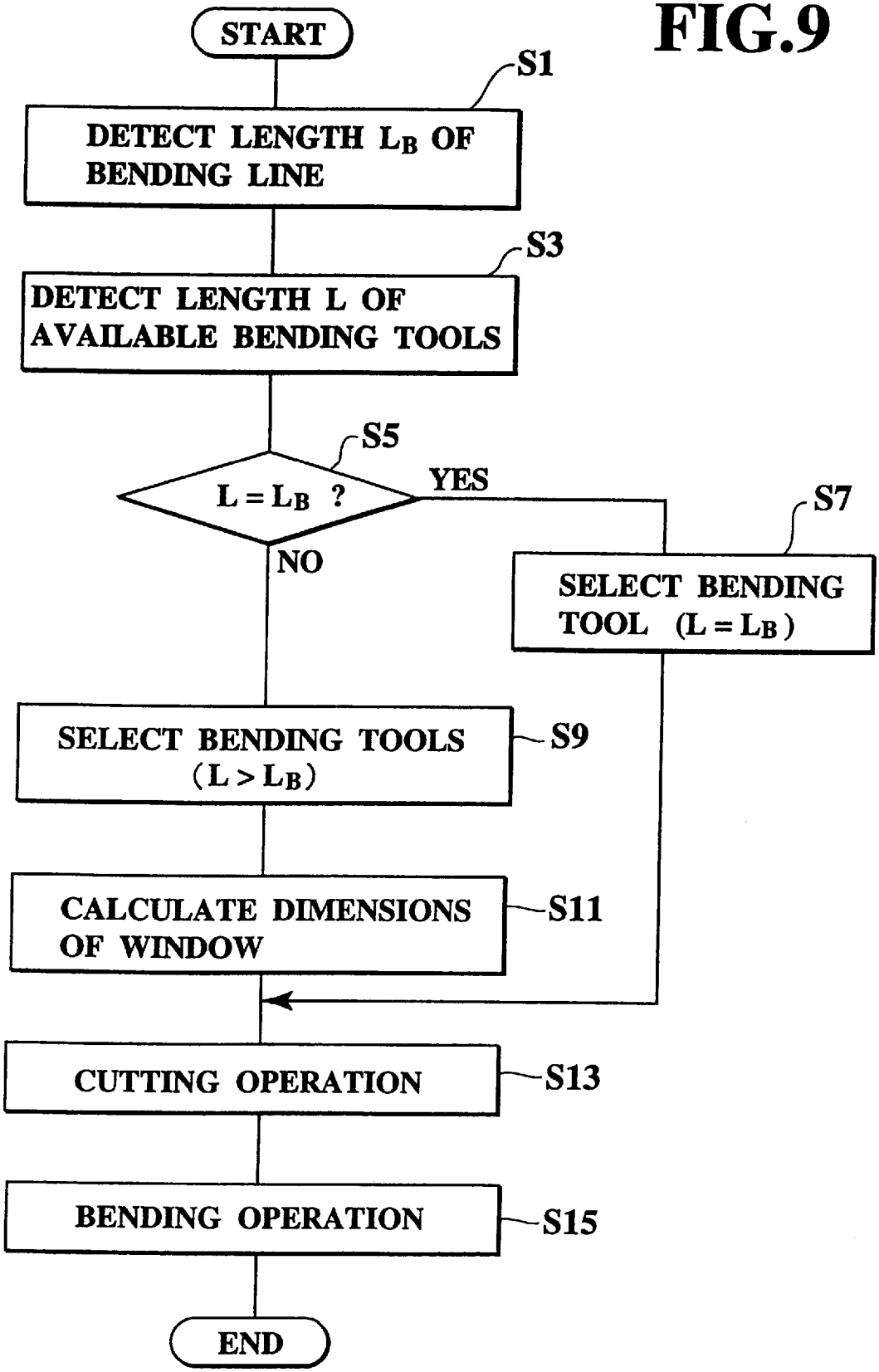
FIG. 9 is a logic flow diagram showing operation of the apparatus of FIG. 8.

FIG. 9 is a logic flow diagram showing operation of the apparatus of FIG. 8.

At step S1, the length LB1, LB2 of a bending line 24, 26 is detected by the bending tool detecting means 114 on the basis of the dimensions of the sheet metal piece 12 that are stored in the memory 120.

At step S3, the lengths L1, L2, L3 of bending tools 30, 32, 34 available for the bending operation are detected by the bending tool detecting means 114 on the basis of the data stored in the memory 118.

At step S5, each length L1, L2, L3 of the available bending tool is compared with the length of the bending line LB1, LB2 by the bending tool selecting means 114.

If a bending tool whose length L1, L2, L3 is the same as the length LB1, LB2 of the bending line 24, 26 is located at step S5, that bending tool is selected at step S7 by the bending tool selecting means 114 as the bending tool to be used in the bending machine 108.

If no bending tool whose length L1, L2, L3 is the same as the length LB1, LB2 of the bending line 24, 26 is located at step S5, then a bending tool whose length L1, L2, L3 is greater than the length LB1, LB2 of the bending line is selected at step S9 by the bending tool selecting means 114.

At step S11, the dimensions LW1, LW2, H1, H2 of the windows 36, 38 are calculated by the window dimension calculating means 116 on the basis of length L1, L2, L3 of the selected bending tool and the widths B1, B2 of flanges 20, 22 to be formed.

At step S13, the cutting operation is carried out by the cutting machine 104 on the basis of data provided by the window dimension calculating means 116 and by the sheet metal piece data memory 118. As a result, the sheet metal is cut along the lines 14 so that the sheet metal pieces 12 are connected to the stiffening frame 18 by the microjoints 16, and windows 36, 38 are formed in the stiffening frame 18, as shown in FIG. 2.

At step S15, bending operation is performed on each of the sheet metal pieces 12 along the bending lines 22, 24 by the selected bending tool 34 selected by the bending tool selecting means 113 and mounted on the bending machine 108.

What is claimed is:

1. A method of forming a sheet metal piece in a metal sheet so that said sheet metal piece is joined by a micro joint to a stiffening frame of said metal sheet, the method comprising the steps of:

forming a window in an area of said stiffening frame adjacent to said sheet metal piece, the window extending from a position corresponding to the end of a flap of said sheet metal piece and along a side of said flap by a length that is at least equal to a width of said flap where a dimension of said window being based upon a dimension of a punch and die pair that are selected from a set of available punch and die pairs based upon a comparison of a length of the selected punch and die pair and the length of at least one bend line of said flap; and bending said flap with said selected punch and die pair.

2. The method of claim 1, wherein said micro joint is formed between an area of said sheet metal piece corresponding to a single face of said bent sheet-metal piece and an area of the stiffening frame facing that area of said sheet metal piece.

3. A metal sheet produced by the process recited in claim 1.

4. A method of manufacturing a sheet metal piece, said sheet metal piece having a bent flange, the method comprising the steps of:

(a) cutting a metal sheet to form said sheet metal piece so that said sheet metal piece is joined to a stiffening frame in said metal sheet by a micro joint;

(b) selecting one of a set of available tool pairs that has a length that is at least equal to the length of at least one bend line of said flange, each of said set of available tool pairs including a punch and a die;

(c) forming a window in an area of said stiffening frame adjacent to said sheet metal piece and extending from a location corresponding to the end of a flap of said sheet metal piece and along a side of said flap by a length that is at least equal to a width of said flap and a dimension of said window being based upon a dimension of said selected tool pair;

(d) bending said sheet metal piece along a bending line using said selected tool pair; and (e) separating said bent sheet metal piece from said stiffening frame.

5. The method of claim 4, wherein the steps of cutting and forming are combined.

6.The method of claim 5, wherein the length of the punch and die is greater than the length of the bending line.

7. The method of claim 6, wherein the window is rectangular, and a sum of the length of the bending line and the length of the window in the direction of the bending line is greater than the length of the punch and die.

8. The method of claim 6, further comprising forming a second window at the other end of said flap.

9. A method of producing at least one sheet metal piece, comprising the steps of:

comparing a length of at least one bend in said at least one sheet metal piece with the lengths of available tool pairs, each of said available tool pairs including a punch and a die;

selecting one of a set of available tool pairs in a bending press that has a length that is at least equal to the length of the at least one bend;

making a cut in a metal sheet that follows a path that defines the perimeter of at least one sheet metal piece, the cut being interrupted at preselected points to form a series of micro joints that join said at least one sheet metal piece with a stiffening frame in said metal sheet, the cut also defining a window in said stiffening frame adjacent to a flap in said at least one sheet metal piece, a dimension of said window being based upon a dimension of said selected tool pair;

bending the flap of the at least one sheet metal piece with the selected one of a set of available tool pairs while the at least one sheet metal piece remains joined to said stiffening frame by said micro joints; and separating the at least one sheet metal piece from the stiffening frame by one of the steps of cutting and breaking said micro joints.

10. The method of claim 9, wherein said window has a first dimension along said bend that forms a free space within said stiffening frame having a length that is one of equal to and greater than the length of the selected available tool pair.

11. The method of claim 9, wherein said window has a second dimension perpendicular from said bend that is one of equal to and greater than the width of said flap.

12. The method of claim 9, wherein said cut also defines another window on an opposite side of said flap.

13. The method of claim 12, wherein each of said windows is quadrangular.

14. An apparatus for a sheet metal piece having a bent flange from a metal sheet, comprising:

a cutting apparatus for cutting the metal sheet to form said sheet metal pieces in said metal sheet so that said sheet metal piece is joined to a stiffening frame of said metal sheet by a micro joint and for forming a window in an area of said stiffening frame adjacent said sheet metal piece and located on an extension line of a bending line of said sheet metal piece; and a first control device that controls the cutting apparatus so that the cutting apparatus forms the window in the stiffening frame; and a second control device that includes a bending tool selecting means that selects a bending tool from a plurality of bending tools and a window dimension calculating means that calculates a dimension of said window based upon a dimension of a selected bending tool, each of said bending tools including a punch and a die.

15. The apparatus of claim 14, wherein the bending tool selecting means compares a length of one of a plurality of available bending tools with a length of said bending line and selects a bending tool that has a length that is greater than said bending line.

16. The apparatus of claim 14, wherein the second control device includes a bending tool data memory that stores the lengths of the available bending tools.

17. The apparatus of claim 14, wherein the second control device includes a sheet metal piece data memory that stores data regarding the shape and dimensions of said sheet metal piece.

18. The apparatus of claim 14, wherein the bending tool selecting means selects a bending tool such that a sum of the length of said bending line and the width of said window in the direction of said bending line is at least equal to the length of said selected bending tool and wherein the cutting apparatus cuts a window with a width in the direction perpendicular to the direction of the bending line that is greater than a length of a flange to be formed by a bending operation.

19. The apparatus of claim 14, wherein the cutting apparatus comprises a laser cutting machine.

20. The apparatus of claim 14, wherein the bending apparatus comprises a press brake.

* * * * *